US007650730B2

(12) United States Patent
Bertuzzi et al.

(10) Patent No.: US 7,650,730 B2
(45) Date of Patent: Jan. 26, 2010

(54) PACKING METHOD AND MACHINE FOR PRODUCING PACKETS OF CIGARETTES

(75) Inventors: Ivanoe Bertuzzi, Casalecchio Di Reno (IT); Roberto Polloni, Modigliana (IT); Andrea Biondi, Bologna (IT); Alessandro Minarelli, Bazzano (IT)

(73) Assignee: G.D Societa' per Azioni, Bologna (IT)

( * ) Notice: Subject to any disclaimer, the term of this patent is extended or adjusted under 35 U.S.C. 154(b) by 33 days.

(21) Appl. No.: 11/807,595

(22) Filed: May 29, 2007

(65) Prior Publication Data

US 2007/0289259 A1 Dec. 20, 2007

(30) Foreign Application Priority Data

May 30, 2006 (IT) ..... BO2006A0419

(51) Int. Cl.
*B65B 19/34* (2006.01)

(52) U.S. Cl. ..... 53/444; 53/228; 53/234; 53/397; 53/580

(58) Field of Classification Search ..... 53/444, 53/228–234, 135.1, 136.1, 389.4, 397, 410, 53/415, 580
See application file for complete search history.

(56) References Cited

U.S. PATENT DOCUMENTS

| | | | | |
|---|---|---|---|---|
| 4,004,395 | A * | 1/1977 | Bardenhagen et al. | 53/396 |
| 5,216,869 | A * | 6/1993 | Boldrini et al. | 53/387.3 |
| 5,996,310 | A * | 12/1999 | Bailey et al. | 53/228 |
| 6,173,551 | B1 * | 1/2001 | Bowman et al. | 53/131.4 |
| 6,373,519 | B1 * | 4/2002 | Sybert et al. | 348/86 |
| 6,612,093 | B1 * | 9/2003 | Grossmann et al. | 53/56 |
| 7,134,257 | B2 * | 11/2006 | Focke et al. | 53/234 |
| 7,240,469 | B2 * | 7/2007 | Ghini et al. | 53/466 |
| 2001/0052217 | A1 * | 12/2001 | Spatafora | 53/234 |
| 2004/0011002 | A1 * | 1/2004 | Sendo et al. | 53/234 |

FOREIGN PATENT DOCUMENTS

| | | |
|---|---|---|
| EP | 1 321 363 | 6/2003 |
| EP | 1 475 306 | 11/2004 |
| WO | 00/75017 | 12/2000 |
| WO | 2005/087595 | 9/2005 |

OTHER PUBLICATIONS

English Abstract of EP 1475306 dated Nov. 10, 2004.

* cited by examiner

*Primary Examiner*—Thanh K Truong
(74) *Attorney, Agent, or Firm*—Ladas & Parry LLP

(57) ABSTRACT

On a packing machine, packets of cigarettes, selected from different alternative packets of cigarettes of at least a first and second type, are produced by transferring groups of cigarettes relative to the selected type of packet from a forming path to a first packing path, along which an inner sheet of packing material is folded about each group of cigarettes, and then to a second packing path, along which at least a collar is folded about each group of cigarettes and on top of the inner sheet of packing material; each group of cigarettes is then transfer red, depending on the type of packet selected, to a third packing path, along which folding of a first outer blank about each group of cigarettes is completed to form a packet of cigarettes of the first type, or to a fourth packing path, along which folding of a second outer blank about each group of cigarettes is completed to form a packet of cigarettes of the second type.

21 Claims, 9 Drawing Sheets

PACKING METHOD AND MACHINE FOR PRODUCING PACKETS OF CIGARETTES

The present invention relates to a packing method and machine for producing packets of cigarettes.

BACKGROUND OF THE INVENTION

In the tobacco industry, groups of cigarettes are conditioned using a relatively large number of different types of packets, each of which differs in shape and/or size and/or, all other things being equal, simply as to the types of blanks used to manufacture it.

SUMMARY OF THE INVENTION

It is an object of the present invention to provide a packing method and machine designed to selectively produce packets of cigarettes of two different types.

According to the present invention, there are provided a packing method and machine for selectively producing packets of cigarettes of two different types, as claimed in the attached claims.

BRIEF DESCRIPTION OF THE DRAWINGS

A number of non-limiting embodiments of the present invention will be described by way of example with reference to the accompanying drawings, in which.

DETAILED DESCRIPTION OF THE INVENTION

Figure 1:
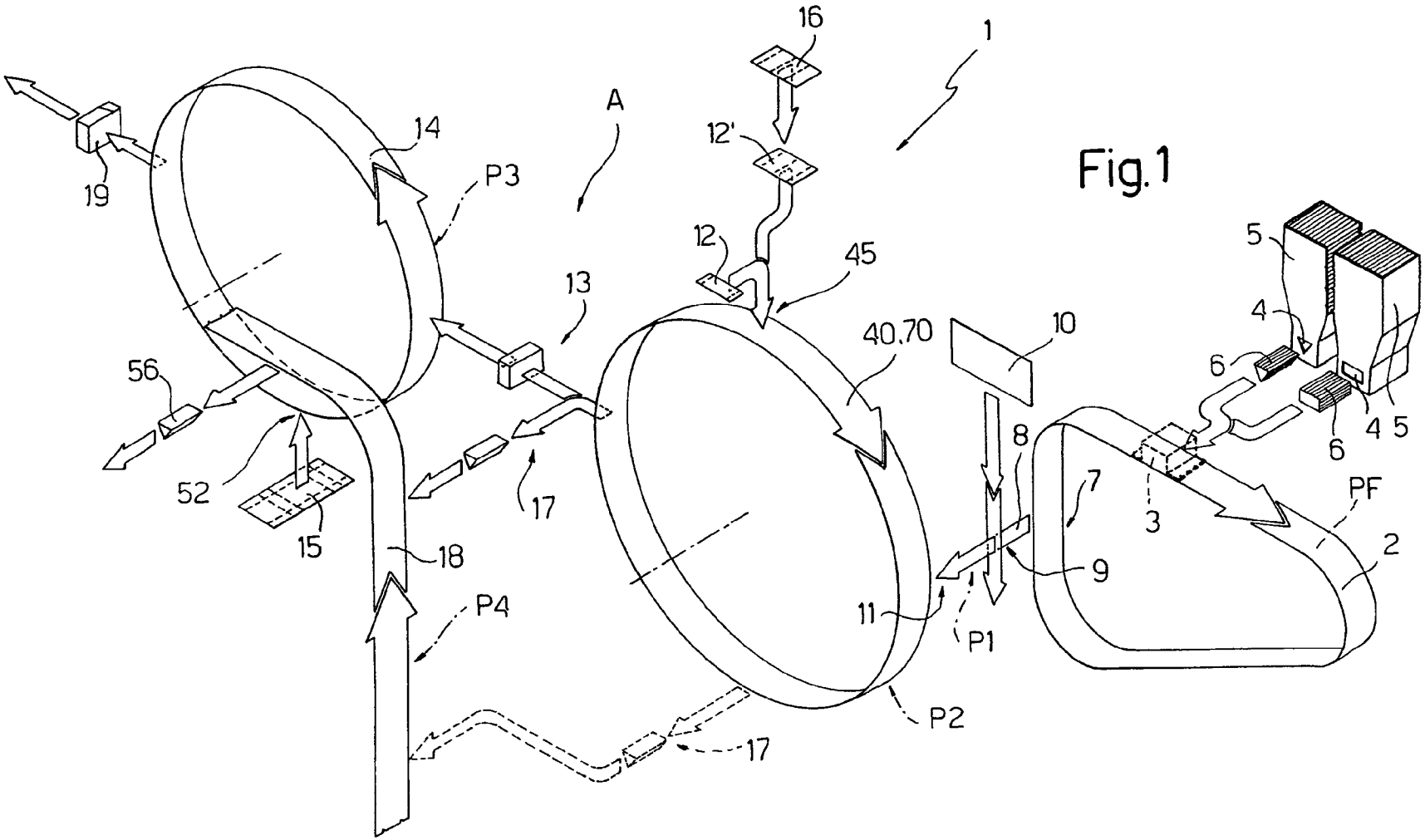
FIG. 1 shows an operating diagram of a packing machine in accordance with the present invention.

FIG. 1 shows the sequence of operations performed on a packing machine 1 to produce a packet of cigarettes of a first type or, by changing certain parts of machine 1, of a second type.

More specifically, the second type of packet may be the same shape and size as the first type, and differ solely as to the blanks employed, or it may be differ entirely from the first type. The alterations to packing machine 1 to produce the second type of packet are fairly extensive in the latter case, and less so in the former.

As shown in FIG. 1, on packing machine 1, a forming conveyor 2 feeds a number of forming pockets 3 along a forming path PF extending in front of outlets 4 of a cigarette hopper 5. The cigarettes in hopper 5 are expelled axially in known manner from outlets 4, and are fed axially in known manner into forming pockets 3 to form, inside each forming pocket 3, a respective group 6 of cigarettes, which is fed by forming conveyor 2, crosswise to the relative cigarettes and along forming path PF, to a transfer station 7, where each group 6 of cigarettes is expelled axially, i.e. parallel to the axes of the relative cigarettes, from relative forming pocket 3, and is transferred to a packing path P1.

Packing path P1 is a straight path extending perpendicularly to path PF; and, once transferred to packing path P1, each group 6 of cigarettes is fed axially by a packing conveyor 8 along packing path P1 and through a loading station 9, where each group 6 of cigarettes is paired with a respective inner sheet 10 of packing material, which is folded about respective group 6 of cigarettes to form an inner wrapping as group 6 of cigarettes travels along packing path P1.

Packing path P1 ends at a transfer station 11 where the wrapped groups 6 of cigarettes, i.e. enclosed in respective inner wrappings, are transferred axially to a packing assembly A perpendicular to packing path P1 and parallel to, but offset with respect to, forming path PF. In other words, packing machine 1 has a Z-shaped layout, and packing path P1 joins by a straight line a point along path PF, defined by transfer station 7, to a point in packing assembly A, defined by transfer station 11.

At transfer station 11, the wrapped groups 6 of cigarettes are fed onto a further packing path P2 extending inside packing assembly A, and along which the wrapped groups 6 of cigarettes are fed transversely, and at least one blank, defined by a collar 12, is folded about each group 6 of cigarettes and on top of respective inner sheet 10 of packing material.

At this point, to produce a first type of packet, each group 6 of cigarettes, on receiving respective collar 12 on top of respective inner sheet 10 of packing material, is transferred, at a further transfer station 13, onto a packing path P3, along which the wrapped groups 6 of cigarettes, complete with respective collars 12, are fed transversely by a packing conveyor 14 forming part of packing assembly A; and at least one further blank, defined by an outer blank 15, is folded about each group 6 of cigarettes and on top of respective inner sheet 10 of packing material and respective collar 12.

Alternatively, to produce a second type of packet, each wrapped group 6 of cigarettes, as it travels along path P2, is paired not only with collar 12, but also with a further blank defined by a respective outer blank 16; and each group 6 of cigarettes, on receiving respective collar 12 on top of respective inner sheet 10 of packing material, and respective outer blank 16 on top of respective collar 12, is transferred, at a transfer station 17, to a packing path P4 differing from packing path P3 and extending inside packing assembly A. Transfer station 17 may coincide with transfer station 13, as in the example shown, or may be located elsewhere along packing path P2, e.g. halfway between transfer stations 11 and 13, as shown by the dash line in FIG. 1.

Along packing path P4, the wrapped groups 6 of cigarettes, complete with respective collars 12 and respective outer blanks 16, are fed transversely by a packing conveyor 18, and each outer blank 16, already partly folded along packing path P2, is folded completely about respective group 6 of cigarettes.

On packing machine 1, the choice between packing paths P3 and P4 depends mainly, but not solely, on the type of outer blank 15 or 16 employed. That is, if a "longitudinal" outer blank 15 is used, i.e. in which the main panels of the outer blank are aligned along an axis parallel to the axes of the cigarettes in relative group 6, then packing path P3 is preferably selected. Alternatively, if a "transverse" outer blank 16 is used, i.e. in which the main panels of the outer blank are aligned along an axis crosswise to the axes of the cigarettes in relative group 6, then packing path P4 is preferably selected.

Figure 2:
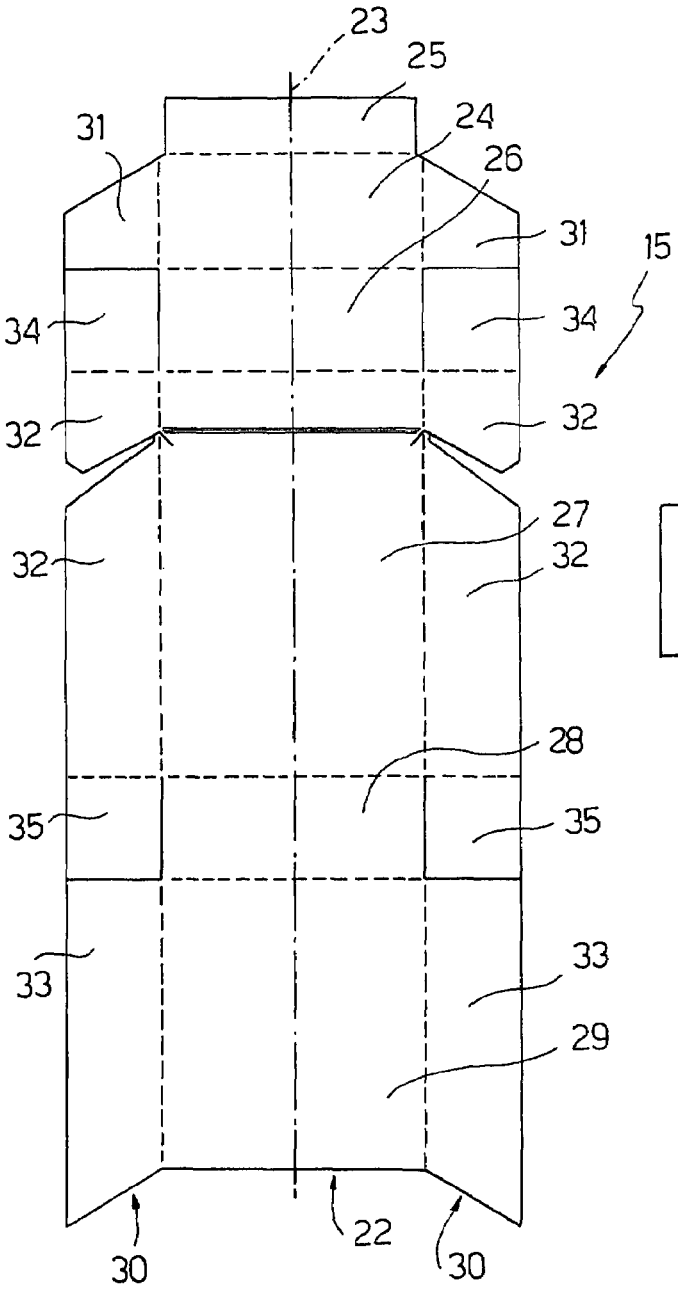
FIGS. 2 and 3 show plan views of blanks of a first type of packet producible using the method according to the present invention.
Figure 3:
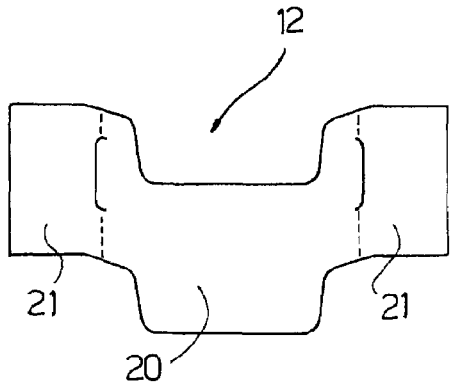
Figure 4:
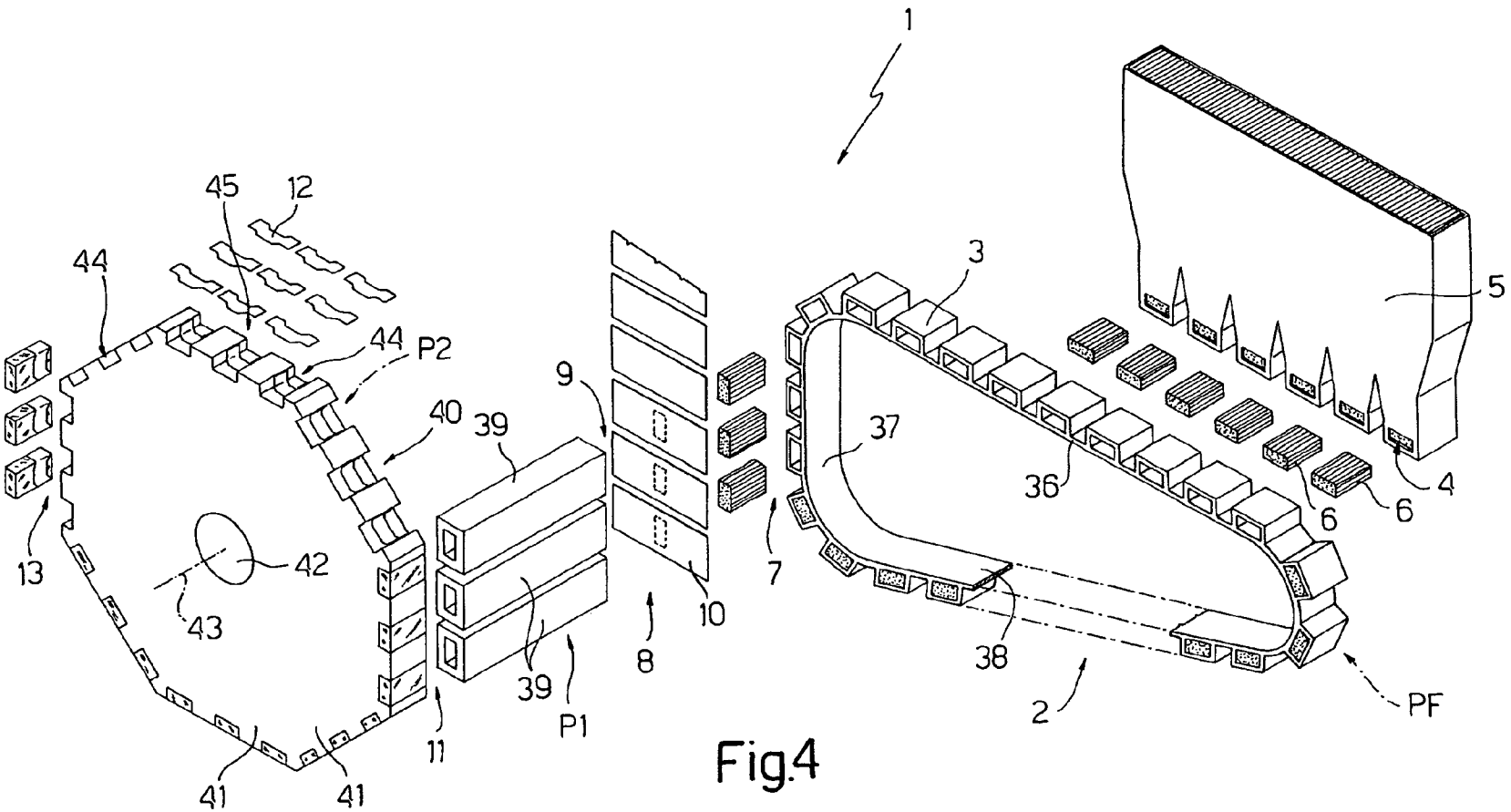
FIGS. 4 and 5 show schematics, with parts removed for clarity, of respective parts of a preferred embodiment of the packing machine according to the present invention, and employing the FIGS. 2 and 3 blanks to produce the first type of packet using the method according to the present invention.
Figure 5:
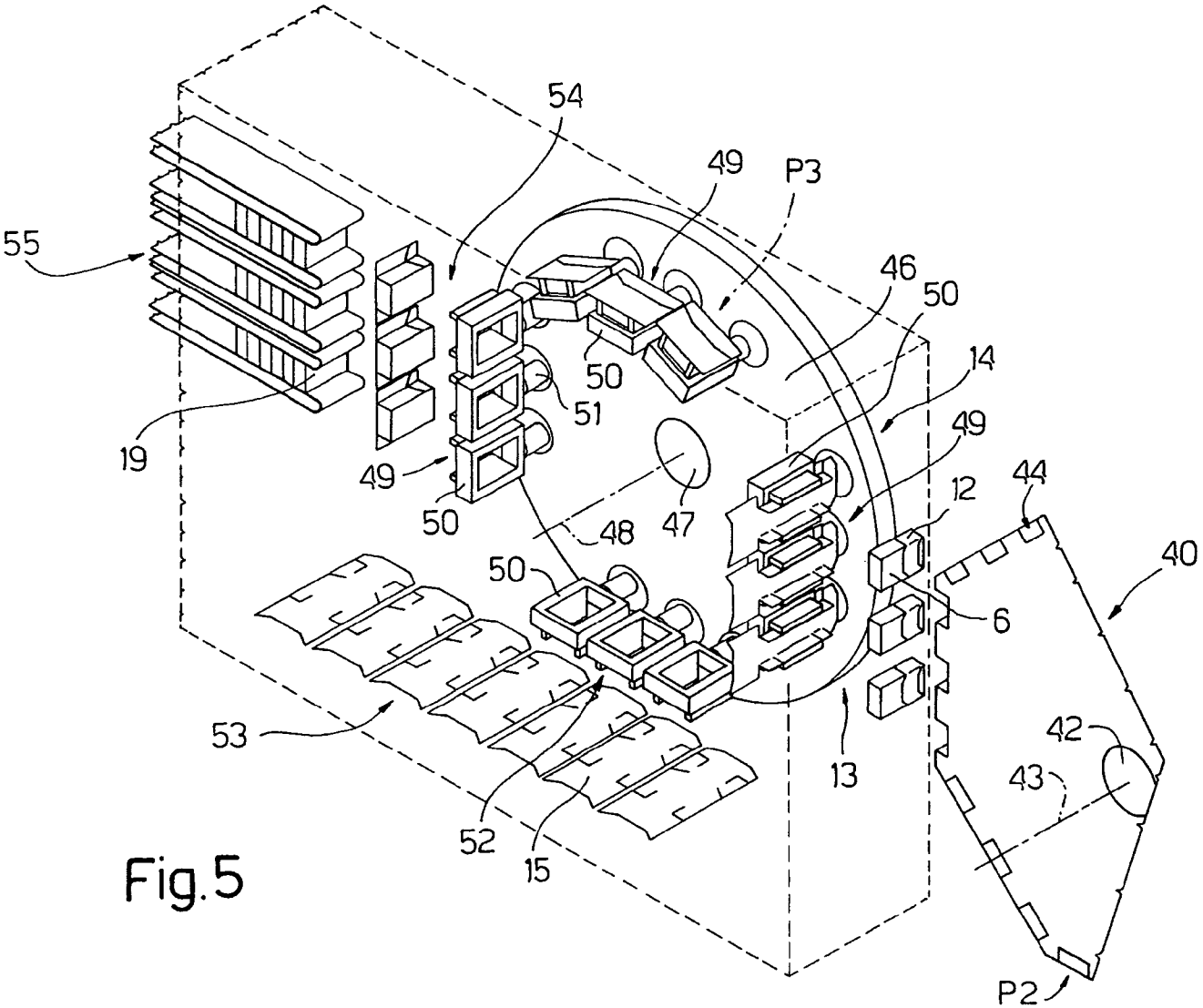

FIGS. 4 and 5 show the configuration of machine 1 in the event the first type of packet for manufacture is, for example, an ordinary hinged-lid, rectangular-section packet 19 (FIG. 5) formed from a collar 12 and an outer blank 15 (FIG. 2), and wherein collar 12 is known and comprises (FIG. 3) a central panel 20, and two lateral wings 21 on opposite sides of and foldable squarely with respect to central panel 20; and outer blank 15 is a "longitudinal" type, is substantially rectangular, and comprises a central portion 22 extending along a longitudinal axis 23, and in turn comprising a front lid panel 24 with a reinforcing flap 25, a top lid panel 26, a rear panel 27, a bottom panel 28, and a front panel 29. Outer blank 15 also comprises two longitudinal lateral wings 30 located on opposite sides of central portion 22, and each comprising a portion 31 extending along front lid panel 24, a portion 32 extending along rear panel 27, a portion 33 extending along front panel 29, a tab 34 extending from portion 32 to portion 31, and a tab 35 extending from portion 32 to portion 33.

As shown in FIG. 4, once expelled axially from respective outlets 4 of hopper 5, groups 6 of cigarettes are fed axially into respective forming pockets 3 of forming conveyor 2, which is a belt conveyor looped, in the example shown, about three pulleys (not shown), is substantially triangular-shaped, and comprises a substantially horizontal loading branch 36 extending in front of outlets 4, and two conveying branches 37, 38, coplanar with each other and with loading branch 36, and of which branch 38 is substantially vertical and extends through transfer station 7.

In the FIG. 4 example, forming conveyor 2 moves forming pockets 3 forward in steps, each three times the length of the spacing of forming pockets 3, so that, for each step of forming conveyor 2, three full forming pockets 3 are arrested at transfer station 7, and respective groups 6 of cigarettes are expelled simultaneously and fed axially through respective loading stations 9 and along respective packing paths P1, the packing conveyors 8 of which are defined at least partly by respective folding conduits 39 superimposed in a substantially vertical plane perpendicular to the substantially vertical plane of forming conveyor 2. Each folding conduit 39 comprises, in substantially known manner, a number of fixed and movable folding devices (not shown) for folding an inner sheet 10 of packing material completely about a respective group 6 of cigarettes as group 6 of cigarettes travels towards transfer station 11.

In the FIG. 4 example, packing path P2 is defined by an octagonal packing wheel 40, which has a number of sides 41, is parallel to forming conveyor 2, and is fitted to a shaft 42 having a substantially horizontal axis 43 parallel to packing paths P1. Each side 41 of packing wheel 40 supports three packing pockets 44, and packing wheel 40 rotates in steps (clockwise in FIG. 4) to stop each side 41 firstly at a loading station 45, where the relative three packing pockets 44 are fed simultaneously and radially with respective collars 12, which are folded into a U inside respective packing pockets 44. Said side 41 is then stopped firstly at transfer station 11—where each packing pocket 44 is aligned with a respective folding conduit 39 to receive axially, i.e. in a direction parallel to axis 43, a respective group 6 of cigarettes wrapped in respective inner sheet 10 of packing material—and finally at transfer station 13. At transfer station 11, each wrapped group 6 of cigarettes is slid axially into respective packing pocket 44 and on top of respective collar 12, so that collar 12 is positioned on the outside of respective inner sheet 10 of packing material.

In the FIG. 5 example, packing conveyor 14, defining at least part of packing path P3, is defined by a packing wheel—hereinafter also indicated 14—which receives groups 6 of cigarettes, complete with respective inner sheets 10 of packing material and respective collars 12, at transfer station 13, and packs them at least partly in respective outer blanks 15.

Packing wheel 14 comprises a body 46 substantially in the form of a flat disk coplanar with packing wheel 40, and fitted to a drive shaft 47 rotating (anticlockwise in FIG. 5) about a respective axis 48 parallel to axis 43. Body 46 supports a number of equally spaced groups 49 of packing pockets 50 along a peripheral portion of body 46. More specifically, in the example shown, each group 49 comprises three packing pockets 50, each of which is connected to the end of a respective shaft 51, which oscillates, with respect to body 46, about its own axis (not shown) and about a respective further axis (not shown), both parallel to axis 48. By means of this twofold oscillation, packing pockets 50 in each group 49 can be positioned aligned and coplanar with one another at a loading station 52 located upstream from transfer station 13, and where each packing pocket 50 is fed radially with a respective outer blank 15 fed to loading station 52 by a conveyor 53; at transfer station 13, where each group 6 of cigarettes, complete with respective inner sheet 10 of packing material and respective collar 12, is expelled radially from respective packing pocket 44 and fed radially into respective packing pocket 50; and at an unloading station 54, where each packet 19, by now substantially finished, is expelled radially from respective packing pocket 50 and completed as it is transferred to a drying conveyor 55 coplanar with packing wheels 14 and 40.

In actual use, each outer blank 15 is loaded into a respective packing pocket 50 with rear panel 27 contacting the bottom of packing pocket 50; with front lid panel 24, top lid panel 26, bottom panel 28, and front panel 29 projecting axially (i.e. in a direction parallel to axis 48) outwards of packing pocket 50; and with at least portion 32 of each longitudinal lateral wing 30 folded squarely. At transfer station 13, each group 6 of cigarettes, complete with respective inner sheet 10 of packing material and respective collar 12, is inserted radially into respective packing pocket 50, onto rear panel 27 and between the folded portions 32 of longitudinal lateral wings 30 of respective outer blank 15, which is folded partly about respective group 6 of cigarettes in known manner (not shown) as respective packing pocket 50 is fed to unloading station 54, and is completed, as stated, during transfer to drying conveyor 55.

Figure 7:
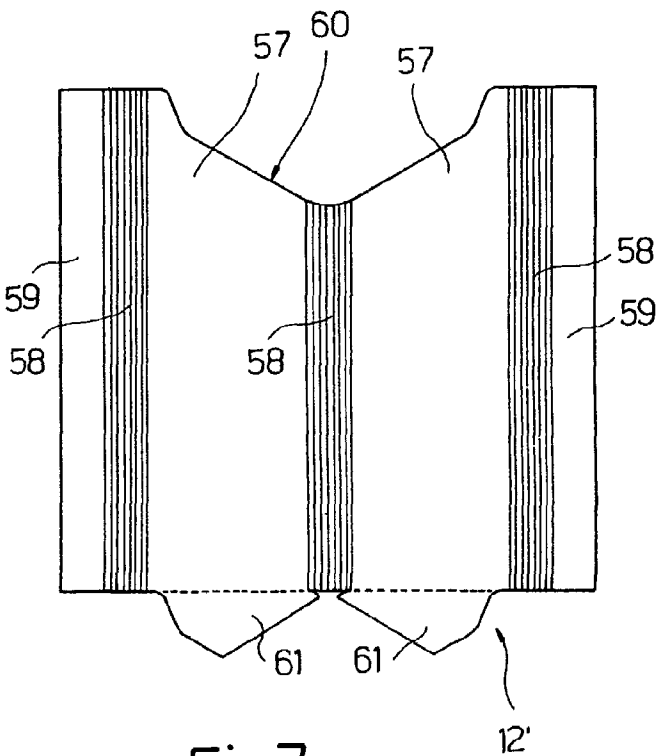
FIGS. 6 and 7 show plan views of blanks of a second type of packet producible using the method according to the present invention.
Figure 6:
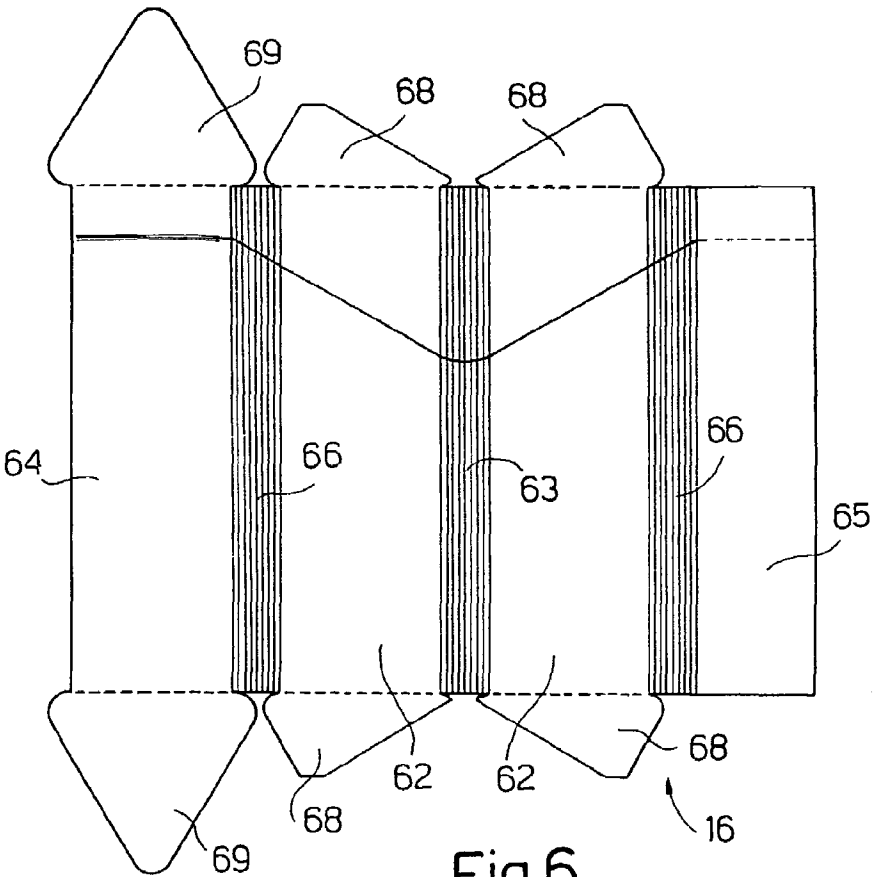
Figure 8:
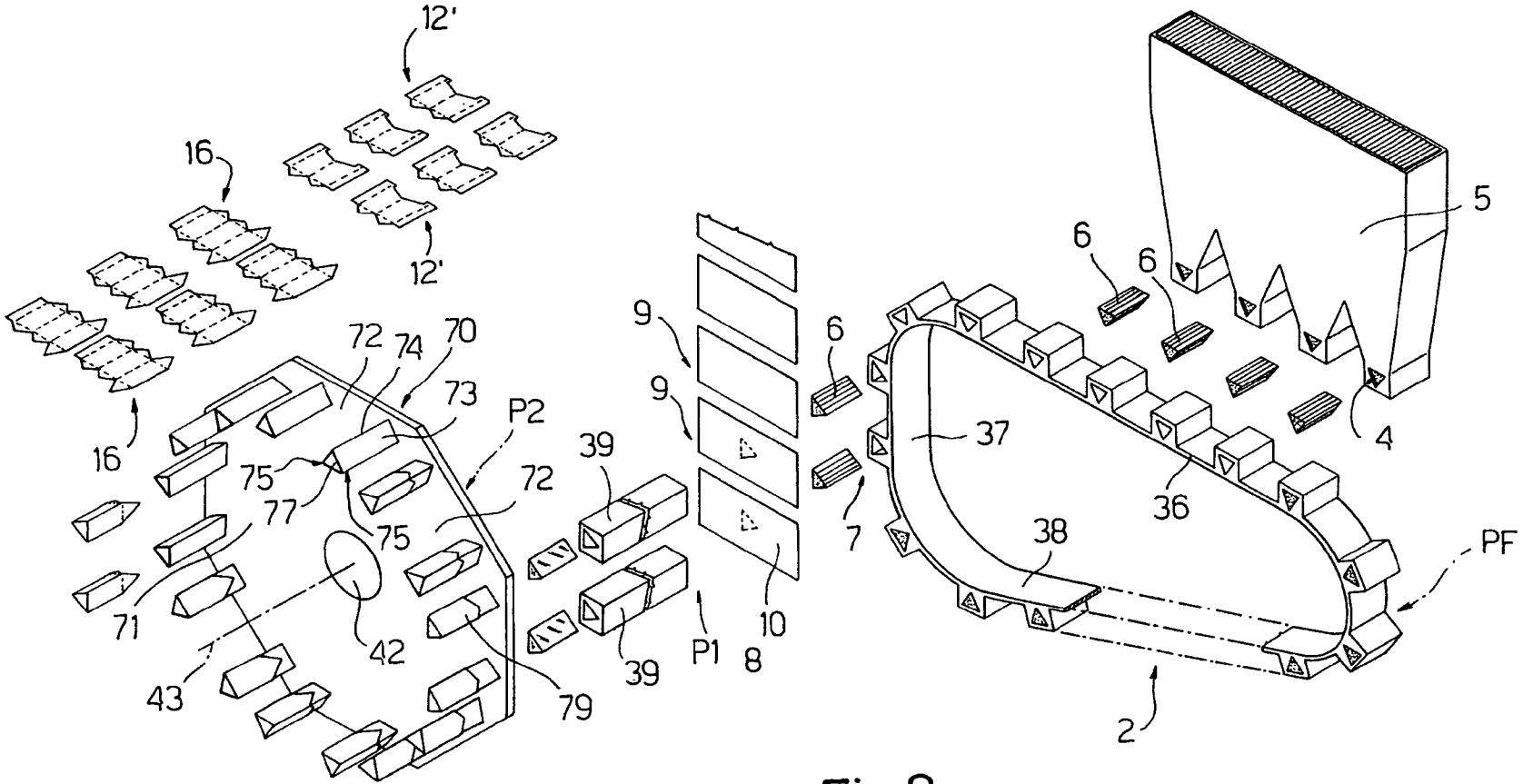
FIGS. 8 and 9 show schematics, with parts removed for clarity, of respective parts of a preferred embodiment of the packing machine according to the present invention, and employing the FIGS. 6 and 7 blanks to produce the second type of packet using the method according to the present invention.
Figure 9:
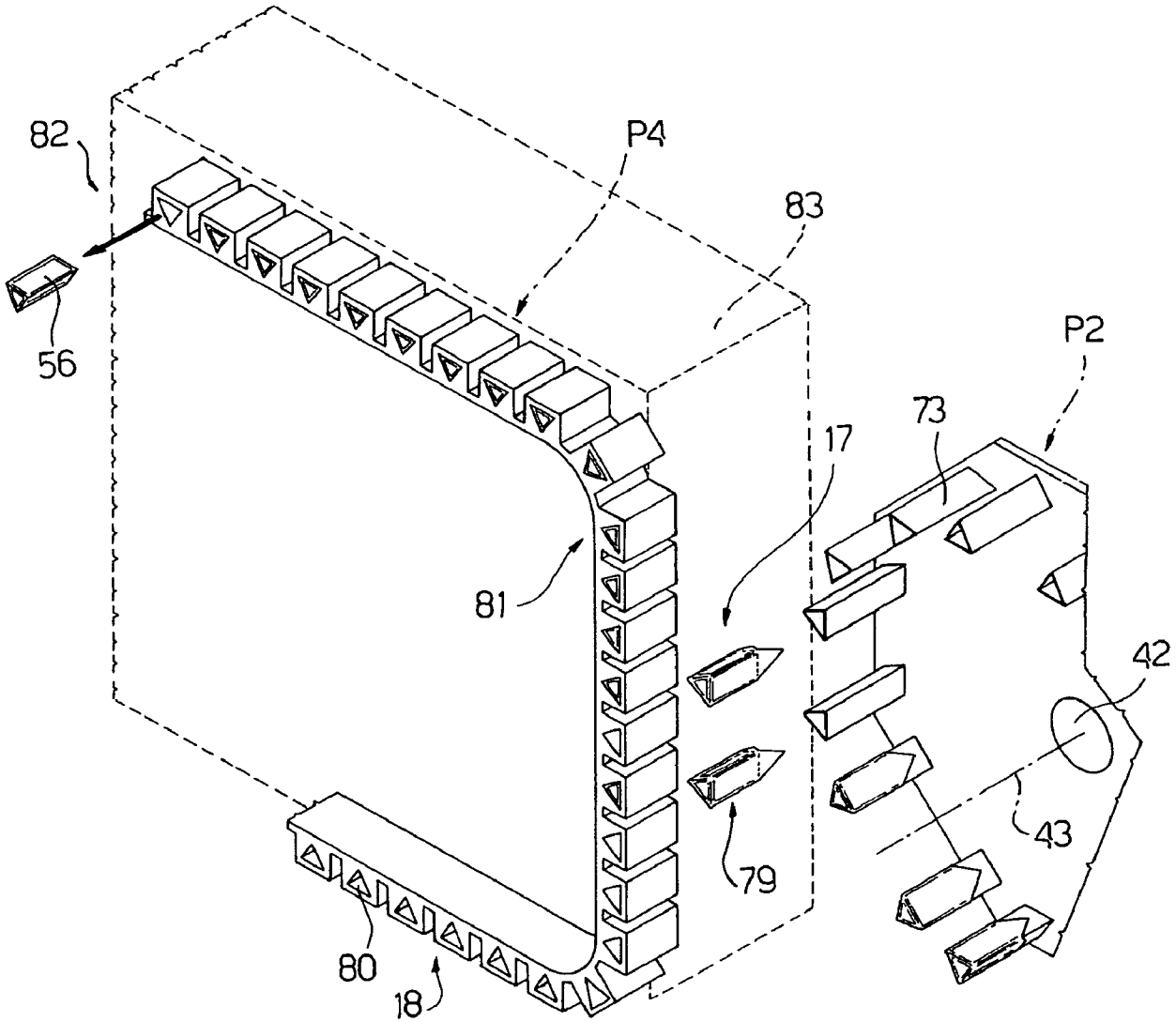
Figure 12:
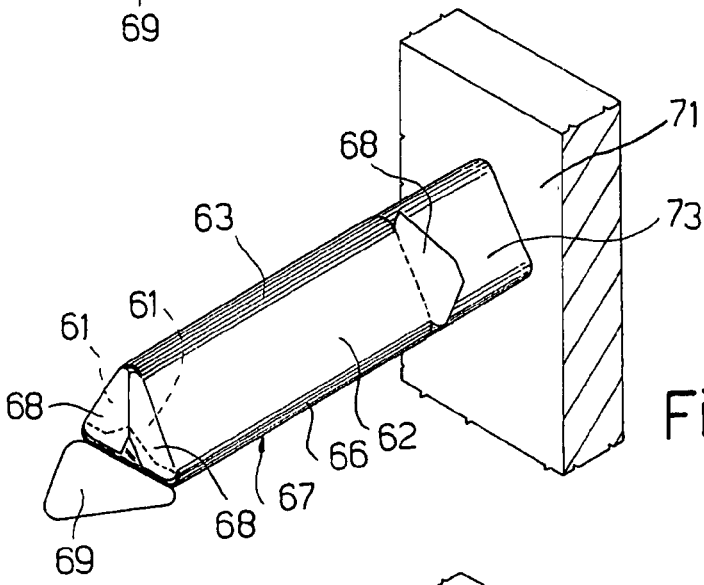

FIGS. 8 and 9 show the configuration of machine 1 for producing, as opposed to packet 19, a second type of packet comprising, for example, a hinged-lid, triangular-section, rounded-edged packet 56 (FIG. 9) formed from a collar 12' (FIG. 7) and a "transverse" outer blank 16 (FIG. 6). Collar 12' comprises two front panels 57 separated by a creased axial band 58 and connected to respective longitudinal lateral wings 59 by respective further creased axial bands 58; and front panels 57 have a recess 60 at one axial end, and respective tabs 61 at the other axial end. Outer blank 16 is substantially rectangular, and comprises two front panels 62 separated by a creased central axial band 63 and connected to respective longitudinal lateral wings 64, 65 by respective creased lateral axial bands 66. Longitudinal lateral wings 64 and 65 are superimposed to define a rear wall 67 (FIG. 12) of packet 56; each front panel 62 has an axial tab 68 at each axial end; and, at each axial end, longitudinal lateral wing 64 has an axial tab 69 of the same shape and size as the cross section of packet 56, while longitudinal lateral wing 65 has no end tabs.

As regards forming path PF and packing path P1, the FIGS. 8 and 9 configuration of packing machine 1 for producing packet 56 is substantially the same as the FIGS. 4 and 5 configuration for producing packet 19. Obviously, since packet 56 chosen by way of example differs totally in shape from packet 19, the cross sections of groups 6 of cigarettes, of outlets 4 of hopper 5, of forming pockets 3, and of folding conduits 39 differ in the FIGS. 8 and 9 packing machine 1. Also, for reasons explained below, forming conveyor 2 advances in steps, each twice the length of the spacing of forming pockets 3, and only two conduits 39 are used.

In connection with the above, it should be pointed out that, if packet 56 were the same shape and size as packet 19, but formed from a "transverse" outer blank 16, the cross sections of groups 6 of cigarettes, of outlets 4 of hopper 5, of forming pockets 3, and of folding conduits 39 would be unchanged.

In packing machine 1 for producing packet 56, packing path P2 is defined by changing packing wheel 40 on shaft 42 with a packing wheel 70, which comprises an octagonal plate 71 having, along each side 72, two tubular through spindles 73 parallel to axis 43. Each tubular spindle 73 projects from the front of octagonal plate 71, has a first rounded edge 74 facing radially outwards and parallel to axis 43, and two further rounded edges 75 facing axis 43, and defines a through conduit 76 of the same shape in cross section as groups 6 of cigarettes, and which is fed axially, at transfer station 11, with a respective group 6 of cigarettes complete with inner sheet 10 of packing material and issuing from respective folding conduit 39.

Figure 10:
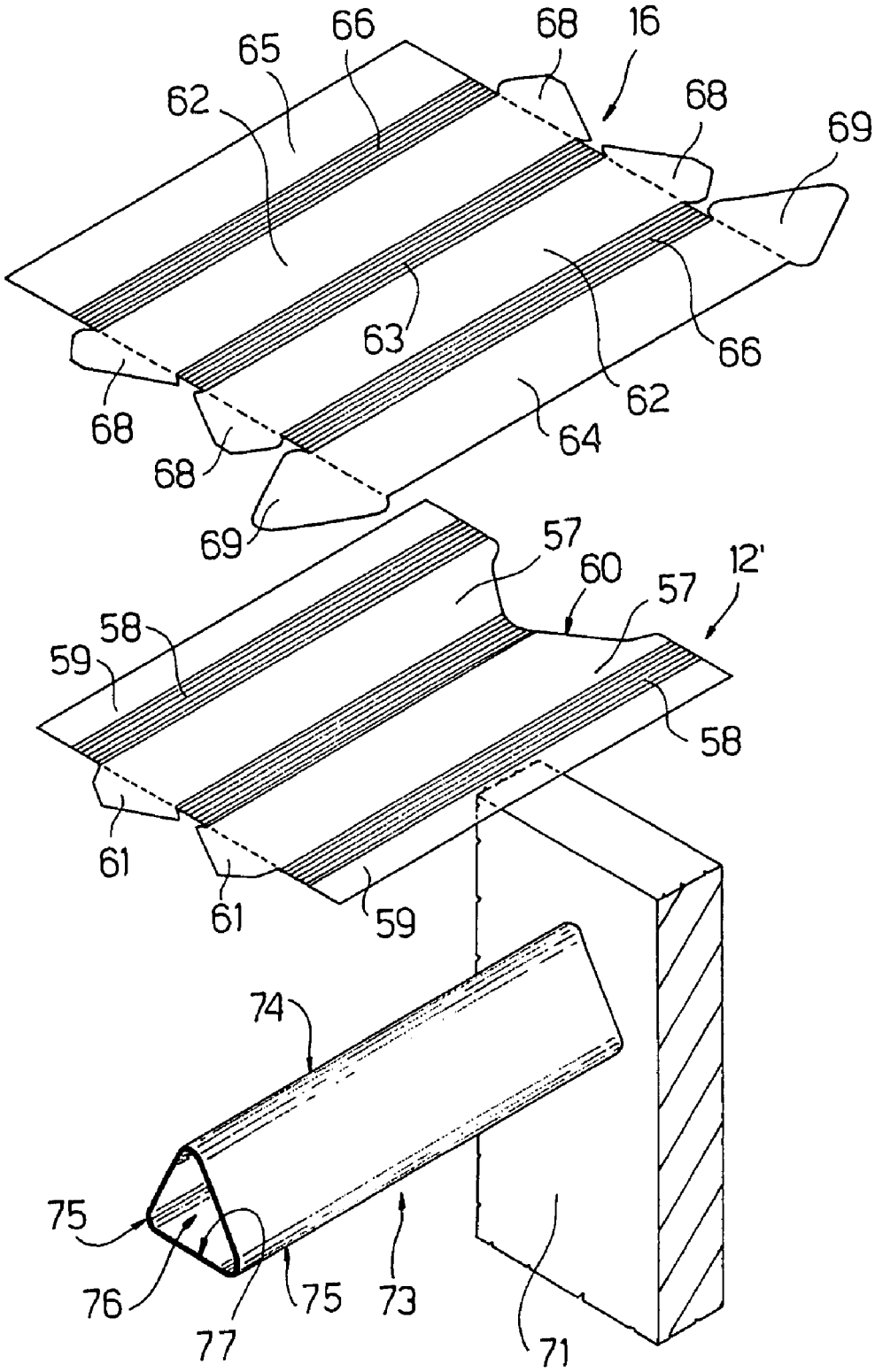
FIGS. 10 to 13 show a sequence of operating steps to fold the FIGS. 6 and 7 blanks.

As shown more clearly in FIG. 10, each tubular spindle 73 is fed simultaneously, at loading station 45, with respective collar 12' and respective outer blank 16, which are superimposed beforehand so that the central axial band 63 of the blank is parallel to axis 43 and faces both the central axial band 58 of collar 12' and edge 74.

In a variation not shown, collar 12' and outer blank 16 are fed successively onto tubular spindle 73.

Since collar 12' and relative outer blank 16 are supplied flat to loading station 45, and packing wheel 70 is the same size as packing wheel 40, three tubular spindles 73 cannot be provided along each side 72 of packing wheel 70. Consequently, the number of tubular spindles 73 per side 72, the number of folding conduits 39, and the number of forming pockets 3 loaded simultaneously are reduced to two.

Figure 11:
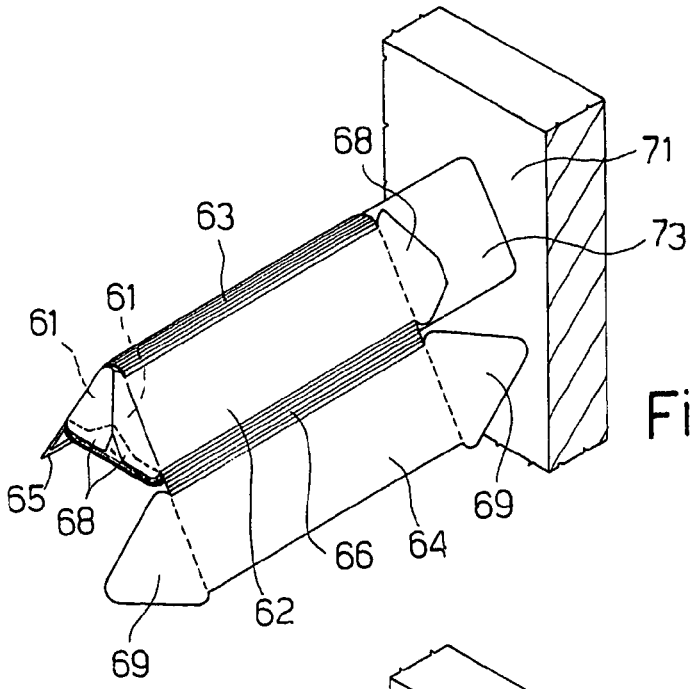
Figure 13:
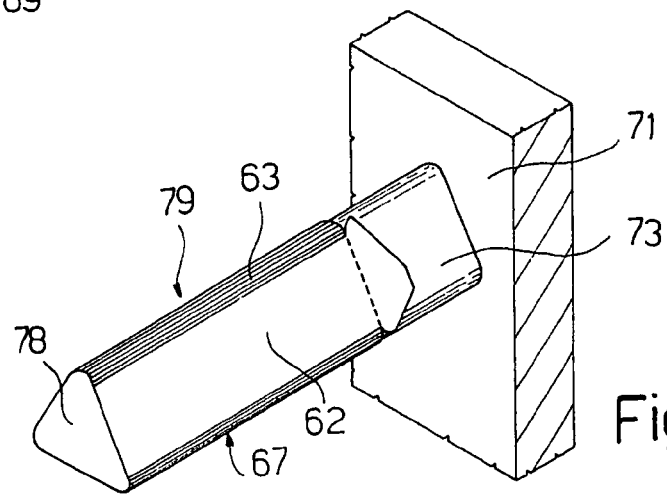

Next (FIG. 11), collar 12' and relative outer blank 16 are lowered simultaneously onto edge 74 and folded gradually (FIGS. 12, 13) about tubular spindle 73; and an end wall 78 of packet 56 is simultaneously formed over the outlet 77 of conduit 76 by squarely folding each axial tab 68 and relative tab 61 projecting axially outwards of outlet 77, and then squarely folding relative axial tab 69. Before reaching transfer station 17, a cup-shaped package 79 is thus formed on each tubular spindle 73, and the end wall 78 of which closes outlet 77 of conduit 76.

Each group 6 of cigarettes, complete with respective inner sheet 10 of packing material, is first pushed axially into conduit 76 of respective tubular spindle 73 and into contact with end wall 78 of respective cup-shaped package 79 at transfer station 11, and is then pushed further axially at transfer station 17 (which, in the FIGS. 8 and 9 example, coincides with transfer station 13) so as to slide out of tubular spindle 73, taking respective cup-shaped package 79 with it, and penetrate axially, together with cup-shaped package 79, inside a respective tubular packing pocket 80 of an endless-belt packing conveyor 81 defining packing path P4 and moving in steps in a direction perpendicular to packing pockets 80.

In connection with the above, it should be pointed out that cup-shaped package 79 and relative collar 12' are unloaded simultaneously from relative tubular spindle 73 at transfer station 17 by virtue of collar 12' comprising tabs 61, which, once folded squarely over outlet 77 of tubular spindle 73, form an integral part of end wall 78. Tabs 61 may obviously be replaced with any mechanical system for fastening outer blank 16 to relative collar 12', or simply by a spot of glue.

As it travels along path P4, each packet 56 is completed by squarely folding axial tabs 68 and 69, at the opposite end to end wall 78, by means of known folding devices (not shown), and is expelled axially from relative packing pocket 80 at an unloading station 82 and fed to a drying conveyor (not shown).

As shown in FIG. 9, packing conveyor 81 is preferably supported by a box frame 83, which is connected to the frame of packing machine 1 over, and without dismantling, packing wheel 14.

The invention claimed is:

1. A packing method for selectively producing, on a single packing machine, packets (19; 56) of cigarettes of different types, the method comprising the steps of:

selecting a type of packet of cigarettes to be produced from a first type or a second type different from the first type:

feeding, by means of a forming conveyor (2), a number of forming pockets (3), for forming groups (6) of cigarettes relative to the selected type of packet (19; 56), along a forming path (PF) extending in front of a cigarette hopper (5);

expelling the cigarettes from the hopper (5) to form the groups (6) of cigarettes relative to the selected type of packet (19; 56) inside the forming pockets (3) of the forming conveyor (2);

transferring the groups (6) of cigarettes from the forming path (PF) to a first packing path (P1);

feeding the groups (6) of cigarettes, by means of a first packing conveyor (8), along the first packing path (P1), along which an inner sheet (10) of packing material is folded about each group (6) of cigarettes;

transferring the groups (6) of cigarettes from the first packing path (P1) to a second packing path (P2); and feeding the groups (6) of cigarettes, by means of a second packing conveyor (40; 70), along the second packing path (P2), along which at least a collar (12; 12') is folded about each group (6) of cigarettes and on top of the inner sheet (10) of packing material;

the method further comprising, depending on the type of packet (19; 56) selected, the further steps of:

when the first type of packet (19) of cigarettes is selected, forming the first type of packet of cigarettes including the steps of: transferring the groups (6) of cigarettes from the second packing path (P2) to a third packing path (P3) of the packing machine (1); and feeding the groups (6) of cigarettes, by means of a third packing conveyor (14), along the third packing path (P3), along which folding of a first outer blank (15) about each group (6) of cigarettes is completed to form a packet (19) of cigarettes of the first type; or when the second type of packet (56) of cigarettes is selected, forming the second type of packet of cigarettes including the steps of: transferring the groups (6) of cigarettes from the second packing path (P2) to a fourth packing path (P4) of said packing machine (1), the fourth packing path (P4) being different from the third packing path (P3) of said packing machine (1); and feeding the groups (6) of cigarettes, by means of a fourth packing conveyor (18), along the fourth packing path (P4), along which folding of a second outer blank (16) about each group (6) of cigarettes is completed to form a packet (56) of cigarettes of the second type;

wherein the first outer blank (15) has first main panels that are aligned along a first axis parallel to axes of the cigarettes, and the second outer blank (16) has second main panels that are aligned along a second axis transverse to the axes of the cigarettes;

wherein the forming of the first type of packet (19) of cigarettes further includes the steps of: folding a first collar (12) about each group (6) of cigarettes along the second packing path (P2); and folding a first outer blank (15) about each group (6) of cigarettes and on top of the first collar (12) along the third packing path (P3);

wherein the second packing conveyor (40) comprises a first packing wheel (40) for folding the first collar (12) about each group (6) of cigarettes; and the third packing conveyor (14) comprises a second packing wheel (14) for folding the first outer blank (15) about each group (6) of cigarettes; and wherein the forming of the second type of packet (56) of cigarettes further includes the steps of: feeding a second collar (12') and a second outer blank (16) onto a relative tubular spindle (73), which is movable alone the second packing path (P2), so that the second outer blank (16) is superimposed on the second collar (12'): feeding the relative group (6) of cigarettes into the relative tubular spindle (73); folding the second collar (12') and the second outer blank (16) together about the tubular spindle (73) to form, on the tubular spindle (73), a cup-shaped package (79), an end wall (78) of which closes an outlet (77) of the tubular spindle (73).

2. A method as claimed in claim 1, wherein the groups (6) of cigarettes are transferred to the third packing path (P3) or the fourth packing path (P4) at separate transfer stations (13, 17) located along the second packing path (P2).

3. A method as claimed in claim 1, wherein the groups (6) of cigarettes are transferred to the third packing path (P3) or the fourth packing path (P4) at coincident transfer stations (13, 17) located along the second packing path (P2).

4. A method as claimed in claim 1, wherein the first packing wheel (40) comprises a number of first pockets (44), each for housing the relative first collar (12) and a relative group (6) of cigarettes.

5. A method as claimed in claim 4, wherein each first pocket (44) is fed first with the relative first collar (12) folded into a U, and then with the relative group (6) of cigarettes.

6. A method as claimed in claim 4, wherein each group (6) of cigarettes is fed axially from the first packing conveyor (8) to the relative first pocket (44) of the first packing wheel (40), and is removed radially from the relative first pocket (44).

7. A method as claimed in claim 1, wherein the second packing wheel (14) comprises a number of second pockets (50), each of which is fed with a relative first outer blank (15), the relative first collar (12), and the relative group (6) of cigarettes.

8. A method as claimed in claim 7, wherein each second pocket (50) is fed first with the relative first outer blank (15) folded into a U, and then with the relative group (6) of cigarettes complete with the relative first collar (12).

9. A method as claimed in claim 7, wherein each group (6) of cigarettes is fed radially to, and is removed radially from, the relative second pocket (50).

10. A method as claimed in claim 1, wherein forming a packet (56) of cigarettes of the second type comprises the steps of: folding a relative second collar (12') together with a relative second outer blank (16) about the relative group (6) of cigarettes along the second packing path (P2); and completing folding of the second outer blank (16) about the relative group (6) of cigarettes and on top of the relative second collar (12') along the fourth packing path (P4).

11. A method as claimed in claim 10 wherein the second packing conveyor (70) comprises a third packing wheel (70) for folding a second collar (12') and, partly, a second outer blank (16) about each group (6) of cigarettes; folding of the second outer blank (16) about each group (6) of cigarettes being completed as the relative group (6) of cigarettes is advanced by the fourth packing conveyor (18).

12. A method as claimed in claim 11, wherein the third packing wheel (70) comprises a number of tubular spindles (73); each group (6) of cigarettes being fed into a relative tubular spindle (73); and the relative second collar (12') and second outer blank (16) being folded on an outer surface of the tubular spindle (73).

13. A method as claimed in claim 12, wherein each group (6) of cigarettes is fed axially from the first packing conveyor (8) to the relative tubular spindle (73) of the third packing wheel (70), and is removed axially from the relative tubular spindle (73).

14. A method as claimed in claim 11, wherein the fourth packing conveyor (18) comprises a belt conveyor (81) comprising a number of tubular pockets (80); each group (6) of cigarettes being fed axially into a relative tubular pocket (80) of the belt conveyor (81), and being expelled axially from the tubular pocket (80).

15. A method as claimed in claim 1, and comprising the further step of securing the second collar (12') and the second outer blank (16) axially to each other.

16. A method as claimed in claim 15, wherein the second collar (12') and the second outer blank (16) are secured axially to each other by folding at least one portion (61) of the second collar (12') to form part of the end wall (78) of the cup-shaped package (79).

17. A method as claimed in claim 1, wherein the second collar (12') and second outer blank (16) are fed to the tubular spindle (73) before the relative group (6) of cigarettes.

18. A method as claimed in claim 1, and comprising the further step of first superimposing the second outer blank (16) on the second collar (12') to feed the superimposed second outer blank (16) and second collar (12') together onto the relative tubular spindle (73).

19. A method as claimed in claim 1, and comprising the further steps of: transferring the cup-shaped package (79) and relative group (6) of cigarettes axially from the tubular spindle (73) into a pocket (80) of the fourth packing conveyor (18); and completing folding of the second outer blank (16), to close the cup-shaped package (79), as the second outer blank travels along the fourth packing path (P4).

20. A method as claimed in claim 1, wherein the cup-shaped package (79) and the relative group (6) of cigarettes are removed axially from the tubular spindle (73) by pushing the group (6) of cigarettes.

21. A method as claimed in claim 1, wherein the second packing conveyor (40; 70) comprises a first packing wheel (40) for producing packets (19) of cigarettes of the first type, or comprises a third packing wheel (70) for producing packets (56) of cigarettes of the second type; the first packing wheel (40) and the third packing wheel (70) being alternative, and being fitted to the same drive shaft (42).

* * * * *